US006192997B1

(12) United States Patent
Tsai et al.

(10) Patent No.: US 6,192,997 B1
(45) Date of Patent: Feb. 27, 2001

(54) PNEUMATIC HAMMER WITH BUFFERS

(76) Inventors: Ten-Weng Tsai; Ten-Ming Tsai, both of No. 243-1, Ming Shend Rd., Wufeng Hsiang, Taichung Hsien (TW)

( * ) Notice: Subject to any disclaimer, the term of this patent is extended or adjusted under 35 U.S.C. 154(b) by 0 days.

(21) Appl. No.: 09/548,395

(22) Filed: Apr. 12, 2000

(51) Int. Cl.[7] ..... B25D 17/10
(52) U.S. Cl. ..... 173/211; 173/162.1; 173/210
(58) Field of Search ..... 173/210, 211, 173/212, 162.2, 162.1, 114, 206, 137; 227/10

(56) References Cited

U.S. PATENT DOCUMENTS

| | | | | |
|---|---|---|---|---|
| 3,894,426 | * | 7/1975 | Kopf | 227/10 |
| 5,163,519 | * | 11/1992 | Mead et al. | 173/211 |
| 5,170,922 | * | 12/1992 | Ehmig et al. | 227/10 |
| 5,417,294 | * | 5/1995 | Suher | 173/206 |
| 5,626,199 | * | 5/1997 | Henry et al. | 173/162.1 |
| 5,873,418 | * | 2/1999 | Arakawa et al. | 173/212 |

* cited by examiner

*Primary Examiner*—Scott A. Smith
(74) *Attorney, Agent, or Firm*—Bacon & Thomas, PLLC

(57) ABSTRACT

A pneumatic hammer has a housing, a handle, an air passage, a sleeve, a cylinder, an actuating head, a reciprocating valve and two buffers. The handle extends from the housing. The air passage is defined in the handle and communicates with the housing. The sleeve communicates with the housing and is slidably mounted in the housing. The cylinder is securely mounted in the sleeve. The actuating head is slidably received in the cylinder. The reciprocating valve is mounted on one end of the cylinder. A buffer abuts each end of the sleeve to provide a shock absorbing effect to the sleeve. Consequently, the shock caused by the actuating head will not be directly transmitted to the housing and handle. The control of the pneumatic hammer can be improved. In addition, an annular recess not aligning with the air passage is defined in the outer periphery of the sleeve and at least one inlet port is defined in the face defining the recess. This provide a safety feature to the pneumatic hammer and improves the safety of using the pneumatic hammer.

13 Claims, 7 Drawing Sheets

PNEUMATIC HAMMER WITH BUFFERS

BACKGROUND OF THE INVENTION

1. Field of the Invention

The present invention relates to a pneumatic hammer, and more particularly to a pneumatic hammer with buffer to absorb the shock to the operator.

2. Description of Related Art

With reference to FIG. 7., a conventional pneumatic hammer in accordance with the prior art comprises a housing (60) and a handle (62) extending from the housing (60) to connect with a high pressure air source with a high-pressure air connector (not shown). A trigger (64) is mounted in the handle (62) to control the high pressure to the housing (60) through an air passage (622) defined in the handle (62). Consequently, the high pressure air can be directed into the housing (60) through the high-pressure air connector and the air passage (622) as the operator squeezes the trigger (64). A cylinder (70) is screwed into the housing (60) and has an actuating head (72) slidably mounted in the cylinder (70). A reciprocating valve (74) is mounted on one end of the cylinder (70) to control the direction of the air flow. The air propels the actuating head (72) forwards and backwards inside the cylinder (70). The actuating head (72) impacts a tool shank (66) that hammers or cuts.

Because the cylinder (70) is rigidly attached to the housing (60), the shock caused by the actuating head (72) striking the tool shank (66) and the end of the cylinder (70) housing the reciprocating valve (74) will be directly transmitted to the housing (60) and handle (62) and subsequently to the operator. The control of the pneumatic hammer will be reduced by the shock. In addition, when the operator squeezes or otherwise depresses the trigger (64), the high-pressure air will flow into the cylinder (70) and instantaneously propel the actuating head (72). Thus the pneumatic hammer easily operates unintentionally when the operator playfully holds the pneumatic hammer. This could easily cause injury to the operator.

To overcome the shortcomings, the present invention tends to provide an improved pneumatic hammer to mitigate or obviate the aforementioned problems.

SUMMARY OF THE INVENTION

The main objective of the invention is to provide an improved pneumatic hammer that significantly reduces the shock transmitted to the operator. The pneumatic hammer in accordance with the present invention has a housing with a handle, a sleeve, a cylinder, an actuating head and two buffers. The handle is integrally formed on the housing. The sleeve is slidably mounted in the housing The cylinder is securely attached to the sleeve. The actuating head is slidably received in the cylinder. A buffer is mounted on and abuts each end of the sleeve. By the arrangement of the buffers, the shock caused by the actuating head will be attenuated before it is transmitted to the housing and the handle. The control of the pneumatic hammer will be improved.

The other objective of the invention is to provide an improved pneumatic hammer that has a built in delay in the operation of the hammer. The pneumatic hammer has an annular recess defined in the outer periphery of the sleeve and at least one inlet defined in the face defining the recess wherein the recess is not aligned with the air passage in the handle. The pneumatic hammer will not operate immediately when the operator squeezes or depresses the trigger until the recess in the sleeve is moved to face the air passage. This improves the safety of using and handling the pneumatic hammer.

Other objects, advantages and novel features of the invention will become more apparent from the following detailed description when taken in conjunction with the accompanying drawings.

DETAILED DESCRIPTION OF THE PREFERRED EMBODIMENT

Figure 1:
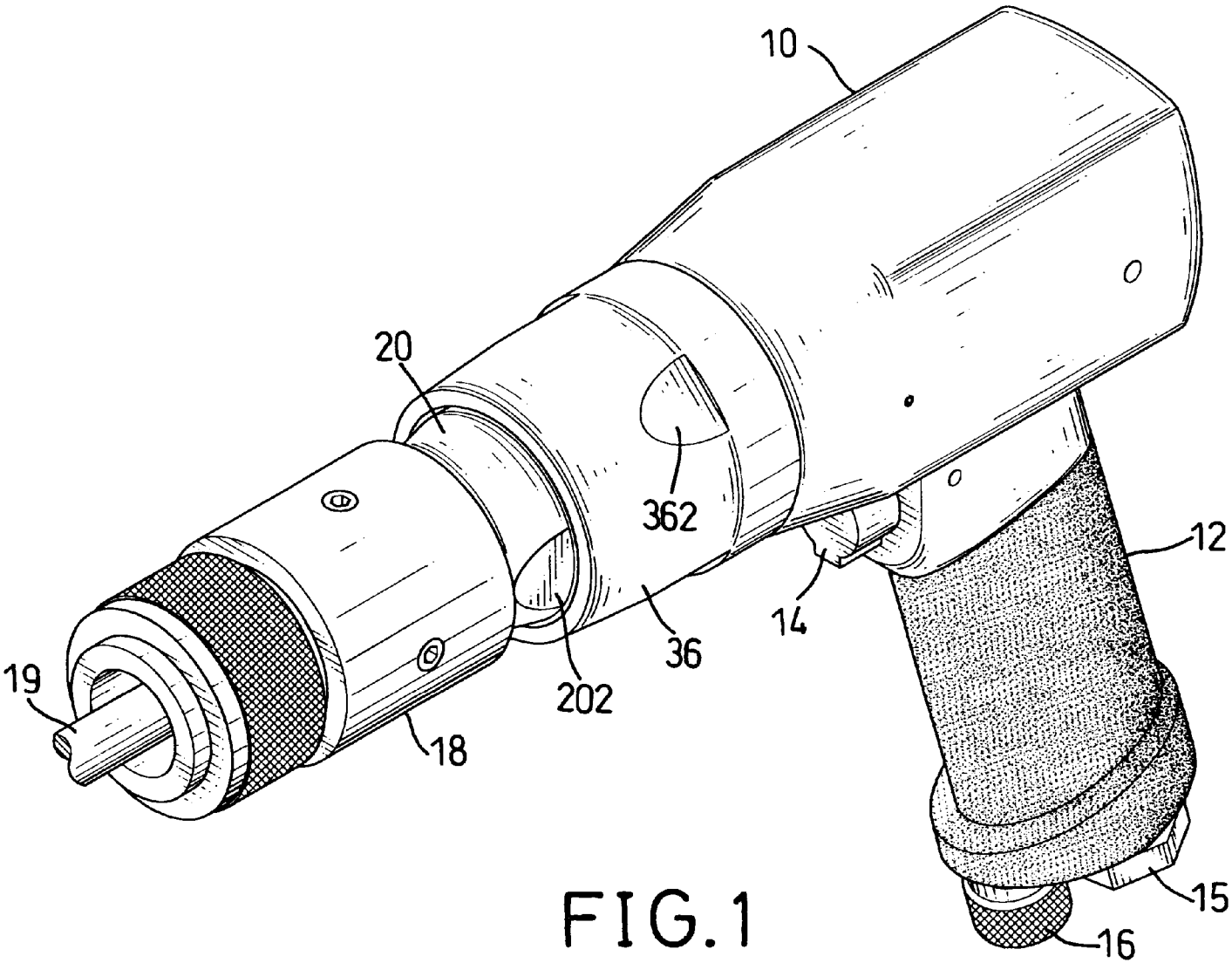
FIG. 1 is a perspective view of a pneumatic hammer in accordance with the present invention.
Figure 2:
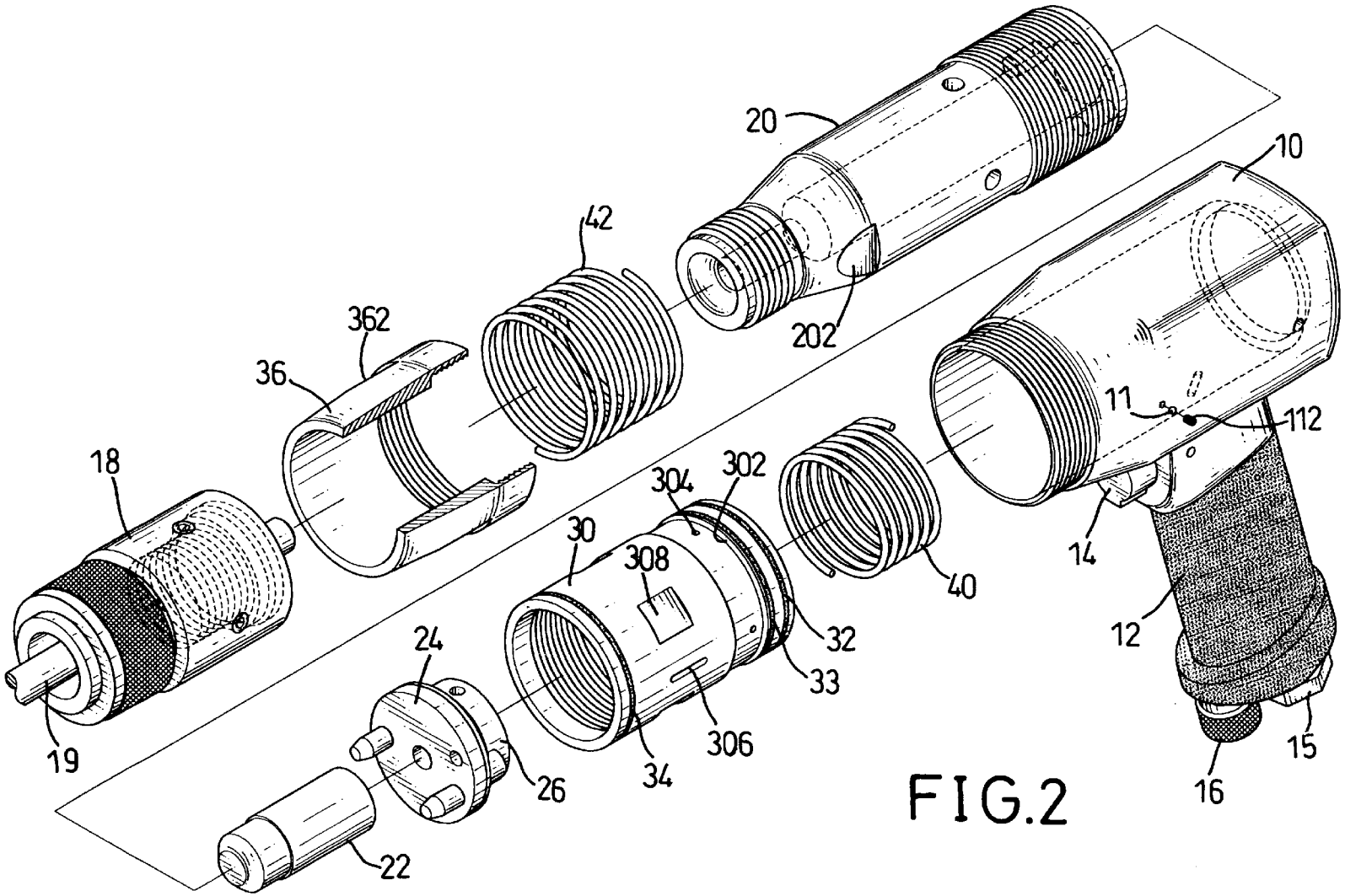
FIG. 2 is an exploded perspective view of the pneumatic hammer in FIG. 1.
Figure 3:
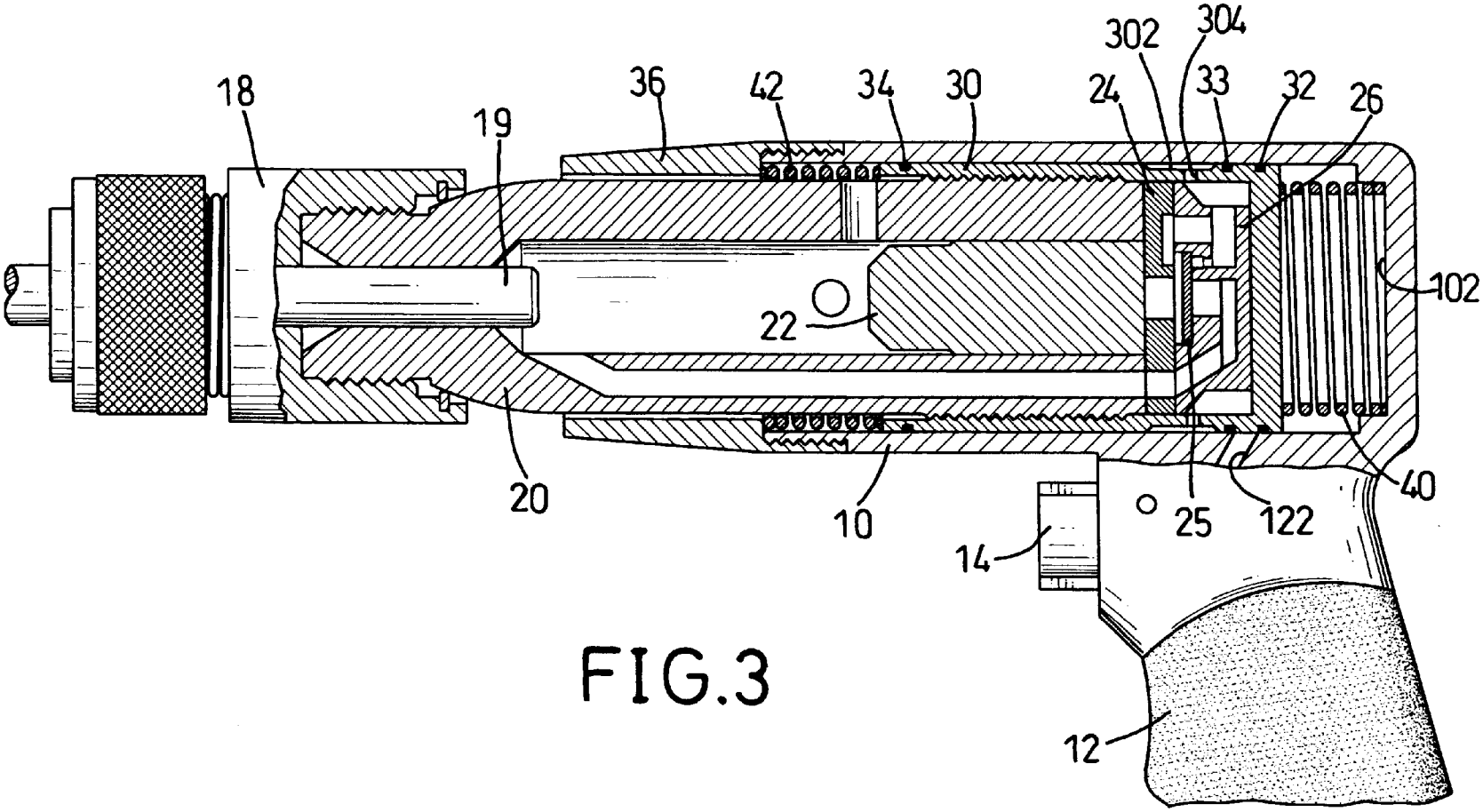
FIG. 3 is a side plan view in partial section of the pneumatic hammer in FIG. 1.

With reference to FIGS. 1–3, a pneumatic hammer in accordance with the present invention comprises a housing (10), a handle (12), a sleeve (30), a cylinder (20), an actuating head (22) and a buffer (40, 42). The handle (12) integrally extends from the housing (10). The sleeve (30) is slidably mounted in the housing (10). The cylinder (20) is securely received in the sleeve (30) in partial. The actuating head (22) is slidably mounted in the cylinder (20). The buffer (40,42) abuts each end of the sleeve (20). The housing (10) has an open end and a closed end. The handle (12) is formed near the closed end of the housing (10). An air passage (122) is defined in the handle (12) and communicates with the housing (10). A high pressure air connector (15) is mounted on the bottom of the handle to connect to a high pressure air source. A trigger (14) is mounted on the handle (12) to control the high pressure to the housing (10) through the air passage (122). A discharge control valve (16) is selectively mounted on the bottom of the handle (12) to control the rate of the flow of the high-pressure air.

The sleeve (30) has an open end facing the open end of the housing (10) and a closed end facing the closed end of the housing (10). A reciprocating valve composed of a valve cover (24), a disk (25) and a valve body (26) is mounted on the end of the cylinder (20) facing the closed end of the sleeve (30). The reciprocating valve controls the direction of the air flow to propel the actuating head (22) forwards and backwards along the cylinder (20).

A tool connector (18) is detachably mounted on the cylinder (20) to insert the end of a tool shank (19) into the cylinder (20). At least one machined surface (202, 308) is defined in the outer periphery of each of the cylinder (20) and the sleeve (30). The machined surfaces (202, 308) allow the cylinder (20) and the sleeve (20) to be respectively held by tools to screw the cylinder (20) and the sleeve (20) together.

A first buffer (40) abuts the closed end of the sleeve (30). A second buffer (42) is mounted around the cylinder (20) and abuts the conjunction between the cylinder (20) and the sleeve (30). A depression (102) is defined in the inner face of the closed end of the housing (10) on the end away from the sleeve (30) to receive the other first buffer (40). A hood (36) is screwed onto the open end of the housing (10). An internal shoulder at the end of the threads in the hood (36) abuts the end of the second buffer (42) away from the sleeve (30) and holds the second buffer (42) in the housing. At least one machined surface (362) is defined in the outer periphery of the hood (36) to allow a tool to securely hold the hood (36) to screw the hood (36) onto the housing (10).

Figure 4:
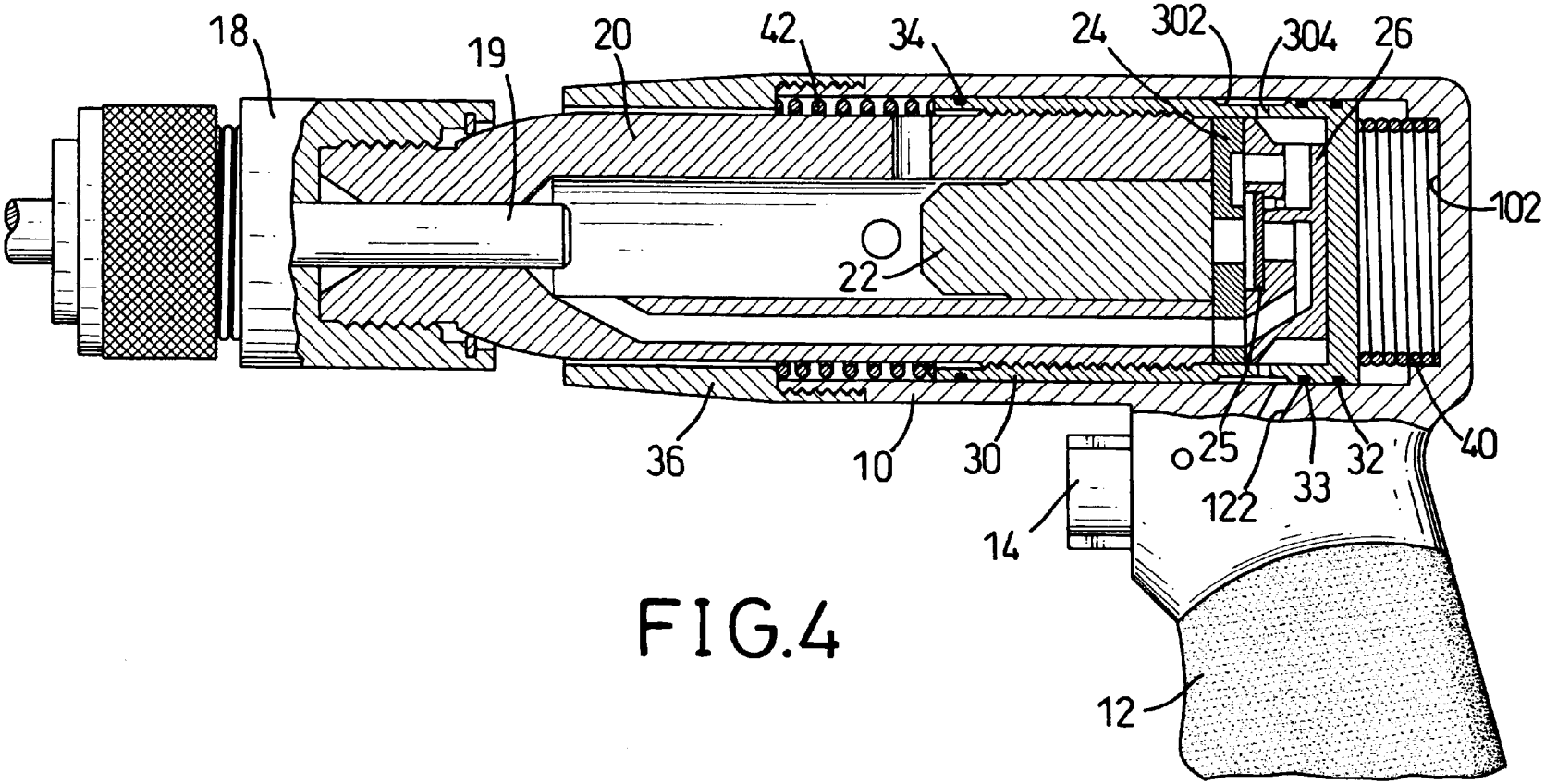
FIG. 4 is an operational side plan view in partial section of the pneumatic hammer in FIG. 1 with the reciprocating valve configured to push the actuating head along the cylinder by the high pressure air.
Figure 5:
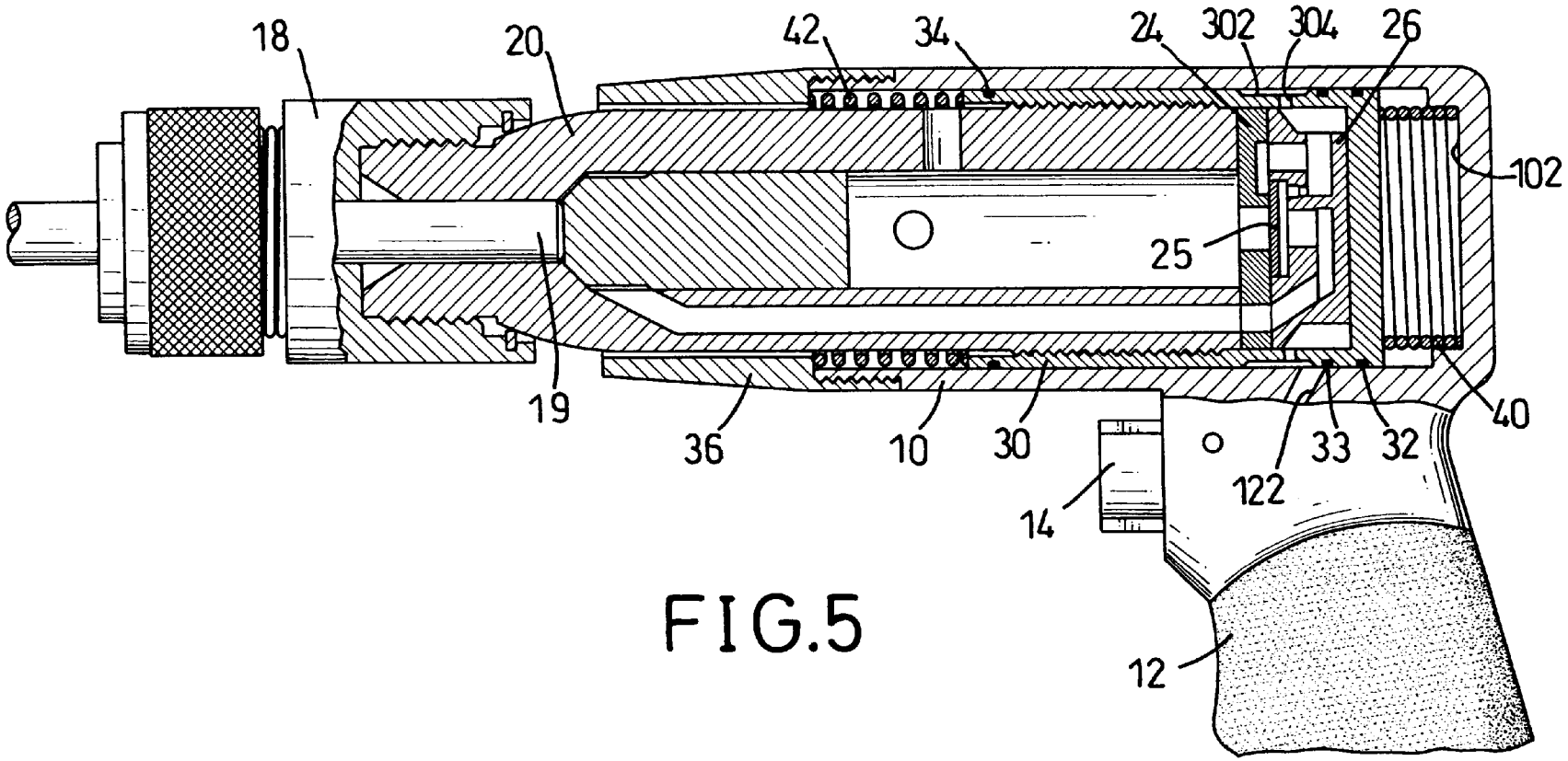
FIG. 5 is an operational side plan view in partial section of the pneumatic hammer in FIG. 1 showing the actuating head being pushed backwards along the cylinder by the high pressure air.

With reference to FIGS. 2, 4 and 5, when the actuating head (20) is propelled forwards and backwards along the cylinder (20) by the high pressure air, the shocks caused by the actuating head (22) striking the tool shank (19) and the cylinder (20) will be transmitted to the sleeve (30) and absorbed by the buffers (40, 42) on the ends of the sleeve (30). This keeps the full force of the shocks from being directly transmitted to the housing (10) and the handle (12), and the control of the pneumatic hammer will be improved.

Referring to FIG. 2, an annular recess (302) is defined in the outer periphery of the sleeve (30). At least one inlet port (304) is defined in the face defining the recess (302) and communicates with the sleeve (30). In one embodiment, the recess (302) faces the air passage (122) in the handle (12), such that the high-pressure air will be led into the sleeve (30) and the pneumatic hammer will operate immediately when the operator squeezes the trigger (14).

In another embodiment, referring to FIGS. 3–5, the sleeve (30) recess (302) does not face the air passage (122) in the handle (12), such that the high pressure air will not be led into the sleeve (30) and the pneumatic hammer will not operate when the operator squeezes the trigger (14). Two O-rings (32, 33) are separately located between the recess (302) and the closed end of the sleeve (30), and the air passage (122) faces the gap defined between the two O-rings (32, 33). Leakage of high-pressure air can be avoided.

To use the pneumatic hammer, the operator must hold the tool shank (19) against the object to be processed. The sleeve (30) and the cylinder (20) will move relative to the housing (10) due to the force between the tool shank (19) and the body, and the sleeve (30) recess (302) will face the air passage (122) in the handle (12). Thus, the high-pressure air can be led into the sleeve (30) through the recess (302) and the inlet ports (304) when the operator pushes the trigger (14). The actuating head (22) will be propelled along the cylinder (20) to impact the tool shank (19) to hammer or cut. When the tool shank (19) is released from the processed object, the sleeve (20) will automatically slide back due to the resilience of the first buffer (40). Consequently, the pneumatic hammer will immediately stop operating when the operator stops applying pressure to the object, even with the trigger (14) depressed. The pneumatic hammer will not operate when the operator does not want to use the pneumatic hammer. This adds a significant safety feature to the pneumatic hammer to keep the operator from being injured by the pneumatic hammer. Additionally, an O-ring (34) is mounted on the sleeve (30) near the open end of the sleeve (30), such that the leakage of high-pressure air can be avoided when the pneumatic hammer is in operation.

Figure 6:
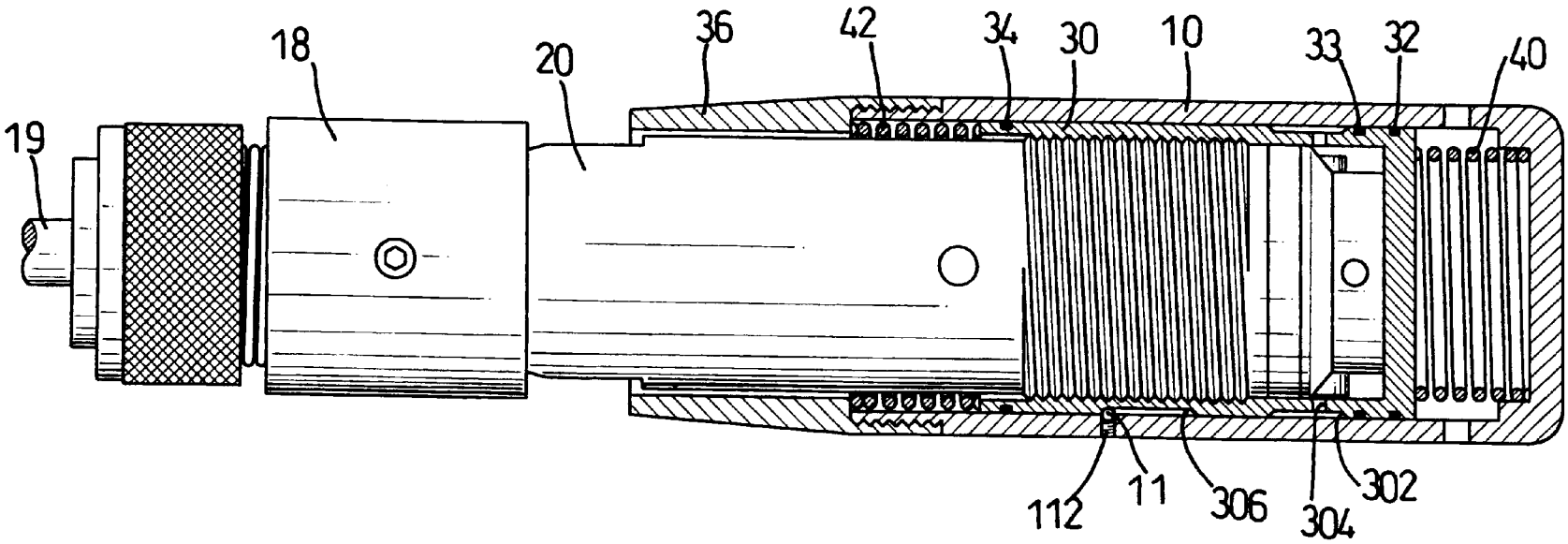
FIG. 6 is a top plan view in partial section of the pneumatic hammer in FIG. 1.
Figure 7:
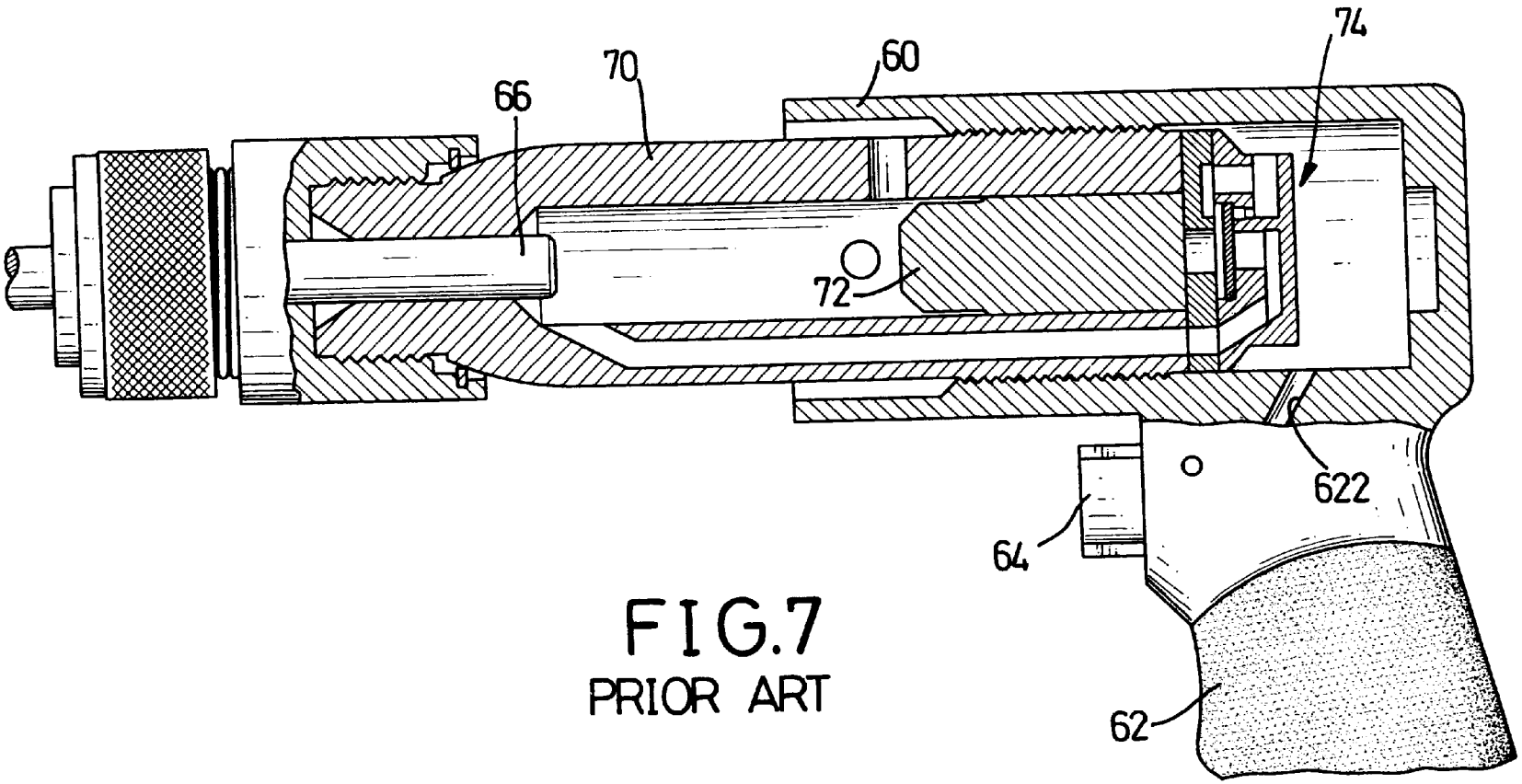
FIG.7 PRIOR ART
FIG. 7 is a side plan view in partial section of a conventional pneumatic hammer in accordance with the prior art.

With reference to FIGS. 2 and 6, a keyway (306) is laterally defined in the outer periphery of the sleeve (30). A threaded hole aligned with the keyway (306) is defined in the housing (10). A steel ball (11) is received in the threaded hole and the keyway (306) simultaneously. A setscrew (112) screws into the threaded hole and abuts the steel ball (11). This keeps the sleeve (30) from rotating relative to the housing (10) due to the engagement between the steel ball (11) and the keyway (306). In addition, the length of the keyway (306) limits the travel of the sleeve (30).

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An pneumatic hammer comprising:

a housing having an open end and a closed end a handle extending from the housing;

an air passage defined in the handle and communicating with the housing;

a sleeve communicating with the housing and slidably mounted in the housing, which has an open end facing the open end of the housing and a closed end facing the closed end of the housing;

a cylinder securely and partially received in the sleeve;

an actuating head slidably received in the cylinder;

a reciprocating valve mounted on one end of the cylinder facing the closed end of the sleeve; and a first buffer abutting the closed end of the sleeve and a second buffer mounted around the cylinder and abutting the jointer between the cylinder and the sleeve to provide an shock absorbing effect to the sleeve.

2. The pneumatic hammer as claimed in claim 1, wherein a depression is defined in an inner face of the closed end of the housing to receive the end of the first buffer away from the sleeve.

3. The pneumatic hammer as claimed in claim 1, wherein a hood is detachably mounted on the open end of the housing and abuts the end of the second buffer away from the sleeve.

4. The pneumatic hammer as claimed in claim 3, wherein at least one machined surface is defined in an outer periphery of the hood.

5. The pneumatic hammer as claimed in claim 1, wherein an O-ring is mounted on the sleeve near the open end of the sleeve.

6. The pneumatic hammer as claimed in claim 1, wherein an annular recess is defined in an outer periphery of the sleeve; and at least one inlet port is defined in the face defining the recess and communicates with the sleeve.

7. The pneumatic hammer as claimed in claim 6, wherein the sleeve recess does not face the air passage in the handle.

8. The pneumatic hammer as claimed in claim 7, wherein two O-rings are separately mounted on the sleeve between the recess and the closed end of the sleeve; and the air passage faces a gap defined between the two O-rings.

9. The pneumatic hammer as claimed in claim 8, wherein an O-ring is mounted on the sleeve near the open end of the sleeve.

10. The pneumatic hammer as claimed in claim 6, wherein the sleeve recess faces the air passage in the handle.

11. The pneumatic hammer as claimed in claim 1, wherein at least one machined surface is defined in an outer periphery of the cylinder.

12. The pneumatic hammer as claimed in claim 1, wherein at least one machined surface is defined in an outer periphery of the sleeve.

13. The pneumatic hammer as claimed in claim 1, wherein a keyway is laterally defined in an outer periphery of the sleeve;

a threaded hole is defined in the housing and aligns with the keyway;

a steel ball is received in the keyway and the threaded hole simultaneously; and a setscrew screws into the threaded hole and abuts the steel ball.

* * * * *